United States Patent [19]

Proud et al.

[11] 4,266,167

[45] May 5, 1981

[54] COMPACT FLUORESCENT LIGHT SOURCE AND METHOD OF EXCITATION THEREOF

[75] Inventors: Joseph M. Proud, Wellesley Hills; Donald H. Baird, Newton, both of Mass.

[73] Assignee: GTE Laboratories Incorporated, Waltham, Mass.

[21] Appl. No.: 92,916

[22] Filed: Nov. 9, 1979

[51] Int. Cl.[3] ..... H05B 41/16; H05B 41/24

[52] U.S. Cl. ..... 315/248; 315/39; 333/24 C

[58] Field of Search ..... 315/248, 39; 333/24 C

[56] References Cited

U.S. PATENT DOCUMENTS

| | | | |
|---|---|---|---|
| 3,942,068 | 3/1976 | Haugsjaa et al. | 315/248 |
| 3,943,403 | 3/1976 | Haugsjaa et al. | 315/248 |
| 4,002,944 | 1/1977 | McNeill et al. | 315/248 |
| 4,063,132 | 12/1977 | Proud et al. | 315/248 |
| 4,185,228 | 1/1980 | Regan | 315/248 |

FOREIGN PATENT DOCUMENTS

| | | | |
|---|---|---|---|
| 457797 | 12/1936 | United Kingdom | 315/248 |
| 369649 | 4/1973 | U.S.S.R. | 315/248 |

*Primary Examiner*—Saxfield Chatmon, Jr.

*Attorney, Agent, or Firm*—William R. McClellan

[57] ABSTRACT

Method an apparatus for general illumination wherein high frequency power is capacitively coupled to a low pressure discharge. A discharge lamp includes an envelope which is typically pear-shaped with a re-entrant cavity. The lamp envelope encloses a fill material which forms during discharge a plasma which emits ultraviolet radiation and has an effective electrical impedance. The lamp envelope typically includes on its inner surface a phosphor coating. An outer conductor, typically a conductive mesh, is disposed around the outer surface of the lamp envelope. A solid or hollow inner conductor is disposed in the re-entrant cavity. The apparatus is configured so that the capacitive impedance associated with coupling of high frequency power from the conductors to the discharge is much less than the plasma impedance. Low capacitive impedance is achieved by utilizing high frequencies and conductors with large surface areas and by maintaining the conductors in close contact with the lamp envelope. Substantially all of the induced electric field is confined within the discharge lamp. The inner conductor can have a shiny surface which is operative to reflect emitted light back to and through the discharge lamp. A high frequency power source can be included in the apparatus.

40 Claims, 8 Drawing Figures

(b)

(a)

(c)

COMPACT FLUORESCENT LIGHT SOURCE AND METHOD OF EXCITATION THEREOF

CROSS REFERENCE TO RELATED APPLICATION

Proud et al, "Compact Fluorescent Light Source Having Metallized Electrodes", Ser. No. 092,914, filed Nov. 9, 1979 and assigned to the same assignee as the present application, contains claims to portions of the subject matter herein disclosed.

BACKGROUND OF THE INVENTION

This invention relates to fluorescent light sources and, more particularly, to compact fluorescent light sources wherein high frequency power is capacitively coupled to a low pressure discharge lamp and to methods for capacitive coupling of high frequency power to low pressure discharges.

The incandescent lamp has been widely used, especially in interior lighting applications. While simple and inexpensive, the incandescent lamp has very low efficacies, typically producing 15 to 20 lumens per watt of electrical power. The operating life of the incandescent lamp is relatively short and unpredictable. The fluorescent lamp, by contrast, exhibits a very long life and a high efficacy, typically 80 lumens per watt of electrical power. Fluorescent sources have been optimized for overhead lighting in the form of straight or circular tubes which are not well adapted to many lighting needs presently met by the incandescent lamp. While conventional electroded fluorescent lamps provide long life and high efficiency, they require large, heavy, and expensive ballasting circuits for operation at line frequencies. An additional problem as one attempts to make small fluorescent lamps is that power losses connected with the electrodes become an increasingly large fraction of the applied power.

In the past, inductive coupling has been used to transfer high frequency electromagnetic power to a low pressure discharge containing a noble gas and mercury vapor. The discharge generates ultraviolet light which is converted to visible light by a phosphor coating on the lamp envelope. Inductive coupling generally utilizes a coil to generate within its volume and the surrounding region an alternating magnetic field and an associated electric field, the latter field lines generally defining a closed path within the conductive plasma discharge. In effect, the current flow within the discharge is such as to form a secondary current in relationship to the driving coil similar to the relationship between the secondary and primary windings of a transformer. Due to collisions, the secondary current in the plasma discharge is somewhat resistive and therefore lossy, part of the loss being converted to light. While the generation of light can be most efficiently accomplished by a uniform excitation of the plasma, the development of closed secondary current paths in the plasma results in non-uniform excitation. Therefore, inductive coupling is not an optimal method for light generation.

Electrodeless fluorescent light sources utilizing inductive coupling have been disclosed in various U.S. Patents. A closed loop magnetic core transformer, contained within a re-entrant cavity in the lamp envelope, induces a discharge in an electrodeless fluorescent lamp in U.S. Pat. No. 4,005,330 issued Jan. 25, 1977 to Glascock et al. Discharge is induced by a magnetic core coil within the envelope of an electrodeless fluorescent lamp in the light source disclosed in U.S. Pat. No. 4,017,764 issued Apr. 12, 1977 to Anderson. In both of the abovementioned patents, the operating frequency is limited to about 50 KHz because of the lossy nature of magnetic materials at high frequency. An electrodeless fluorescent light source utilizing an air-core coil for inductive coupling at a frequency of about 4 MHz is disclosed in U.S. Pat. No. 4,010,400 issued Mar. 1, 1977 to Hollister. However, such a light source has a tendency to radiate power at the frequency of operation and exhibits non-uniform plasma excitation as described hereinabove.

An electrodeless fluorescent light source, utilizing frequencies in the 100 MHz to 300 GHz range, was disclosed by Haugsjaa et al in U.S. Pat. No. 4,189,661, issued Feb. 19, 1980 and assigned to the assignee of the present invention. High frequency power, typically at 915 MHz, is coupled to an ultraviolet-producing low pressure discharge in a phosphor-coated electrodeless lamp which acts as a termination load within a termination fixture.

By contrast to inductive coupling, the excitation of a plasma by capacitive coupling produces a stable and uniform plasma, a condition conducive to maximal light generation. In this case, the electric field lines of the applied oscillatory electromagnetic signal originate on one external electrode, pass through the envelope containing the discharge and terminate on a second external electrode. No closed current paths exist within the plasma in contrast to the situation occurring in inductively coupled plasma discharges described hereinabove.

Capacitive coupling of an electromagnetic pulse to a low pressure discharge in an elongated laser discharge tube is disclosed by Proud et al in pending U.S. application Ser. No. 20,576 filed Mar. 15, 1979 and assigned to the assignee of the present invention. External electrodes are coupled to end portions of the laser discharge tube. The generation of a light emitting, low pressure discharge in a resonant device including an inner electrode and a coaxial outer electrode is disclosed in U.S. Pat. No. 4,063,132 issued Dec. 13, 1977 to Proud et al. The resonant cavity between the electrodes is occupied in part by an annular electrodeless lamp. Repetitive bursts of high frequency oscillations occurring within the cavity are capacitively coupled to a discharge within the electrodeless lamp.

SUMMARY OF THE INVENTION

An object of the present invention is to provide a method for the efficient transfer of electromagnetic power by capacitive coupling to a low pressure discharge.

Another object of the present invention is to provide apparatus wherein high frequency power is efficiently transferred by capacitive coupling to a low pressure discharge lamp.

These and other objects and advantages are achieved by a method for capacitive excitation, by high frequency power, of a low pressure discharge in a discharge lamp which has a lamp envelope made of a light transmitting substance and encloses a fill material which forms during discharge a plasma which emits untraviolet radiation and has an effective electrical impedance. According to the disclosed method, a first conductor is positioned in close proximity to a first external surface region of the discharge lamp such that the first conductor and the plasma act as a first electrode pair, separated by the lamp envelope, of a first capacitor which is configured to have an impedance, at the frequency of operation, which is much less than the impedance of the plasma. A second conductor is positioned in close proximity to a second external surface region of the discharge lamp such that the second conductor and the plasma act as a second electrode pair, separated by the lamp envelope, of a second capacitor which is configured to have an impedance, at the frequency of operation, which is much less than the impedance of the plasma. The first and second conductors are positioned relative to each other so that, when a high frequency voltage is applied between the first and second conductors, inducing an electric field therebetween, substantially all of the electric field is confined within the electrodeless lamp. High frequency power is applied to the first and second conductors for inducing an electric field in the lamp and causing discharge therein.

According to another aspect of the present invention, an electromagnetic discharge apparatus for capacitive excitation of a low pressure discharge by high frequency power includes a discharge lamp, an outer conductor, an inner conductor, and means for coupling the apparatus to a source of high frequency power. The discharge lamp has a lamp envelope made of a light transmitting substance. The lamp envelope includes an outer surface and at least one re-entrant cavity and encloses a fill material which forms during discharge a plasma which emits ultraviolet radiation and has an effective electrical impedance. The outer conductor is disposed around the outer surface of the envelope such that the outer conductor and the plasma act as a first electrode pair, separated by the lamp envelope, of a first capacitor which is configured to have an impedance at the frequency of operation which is much less than the impedance of the plasma. The inner conductor is disposed in the re-entrant cavity such that the inner conductor and the plasma act as a second electrode pair, separated by the lamp envelope, of a second capacitor which is configured to have an impedance at the frequency of operation which is much less than the impedance of the plasma. The inner and outer conductors are positioned so that, when a high frequency voltage is applied between the inner and outer conductors, inducing an electric field therebetween, substantially all of the electric field is confined within the discharge lamp. High frequency power applied to the inner and outer conductors induces an electric field in the envelope and causes discharge.

The discharge lamp envelope can include on its inner surface a phosphor coating which emits visible light upon absorption of ultraviolet radiation. The lamp envelope can include a base region through which the re-entrant cavity passes and an enlarged region wherein the re-entrant cavity terminates and which has a larger cross-sectional area than the base region. The lamp envelope is tapered inwardly from the enlarged region to the base region to form a continuous outer surface. The apparatus can include a high frequency power source.

Figure 1:
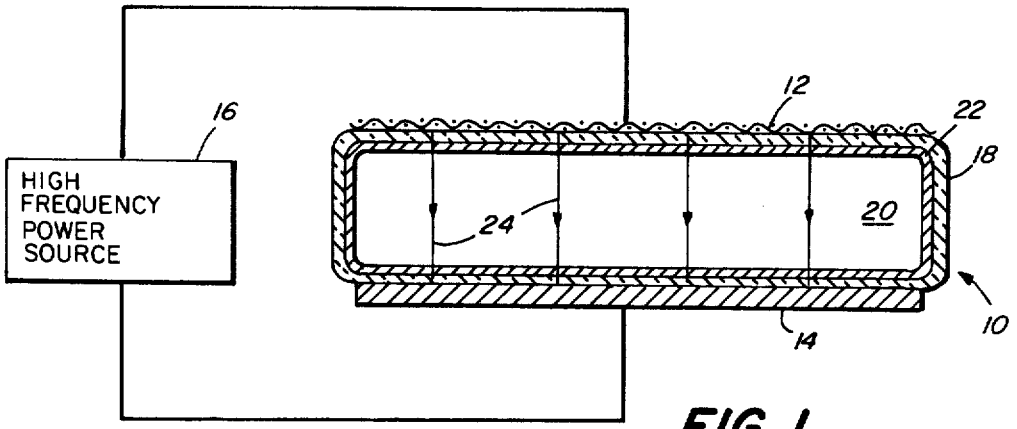
FIG. 1 illustrates a capacitively coupled fluorescent light source having planar geometry.

FIG. *2a* is a schematic diagram of the light source of FIG. 1 wherein the discharge lamp and associated conductors are represented by an impedance $Z_L$.

FIG. *2b* is a schematic diagram of the light source of FIG. 1 wherein the discharge lamp and associated conductors are represented by a simplified equivalent circuit.

FIG. *2c* is a schematic diagram of the light source of FIG. 1 wherein the discharge lamp and associated conductors are represented by an impedance $Z_L$ and wherein a matching network to optimize transfer of power to $Z_L$ is included.

Figure 3:
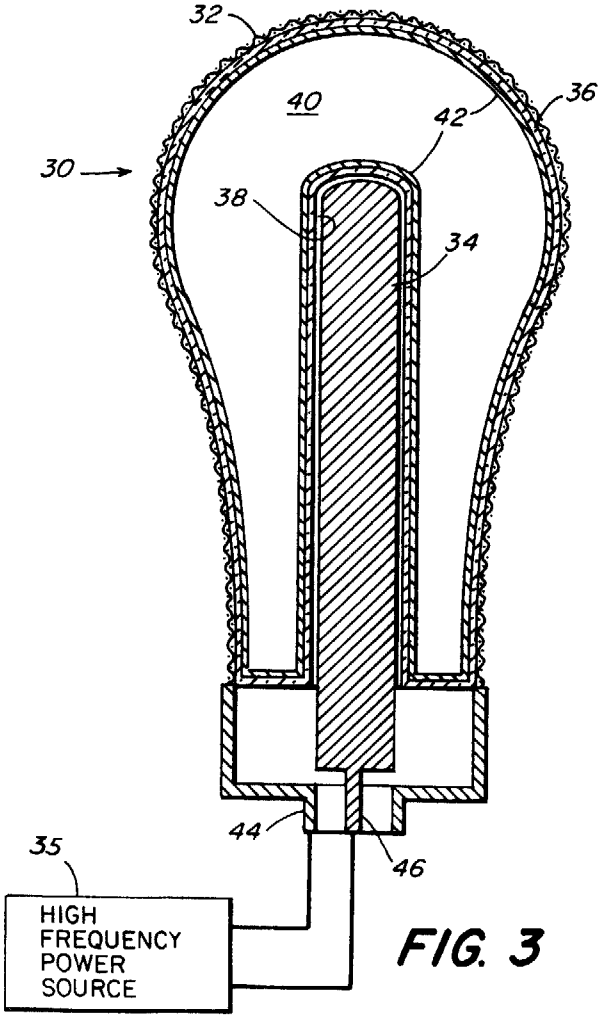

FIG. 3 illustrates a capacitively coupled compact fluorescent light source which is pear-shaped and has a solid or hollow inner conductor.

Figure 4:
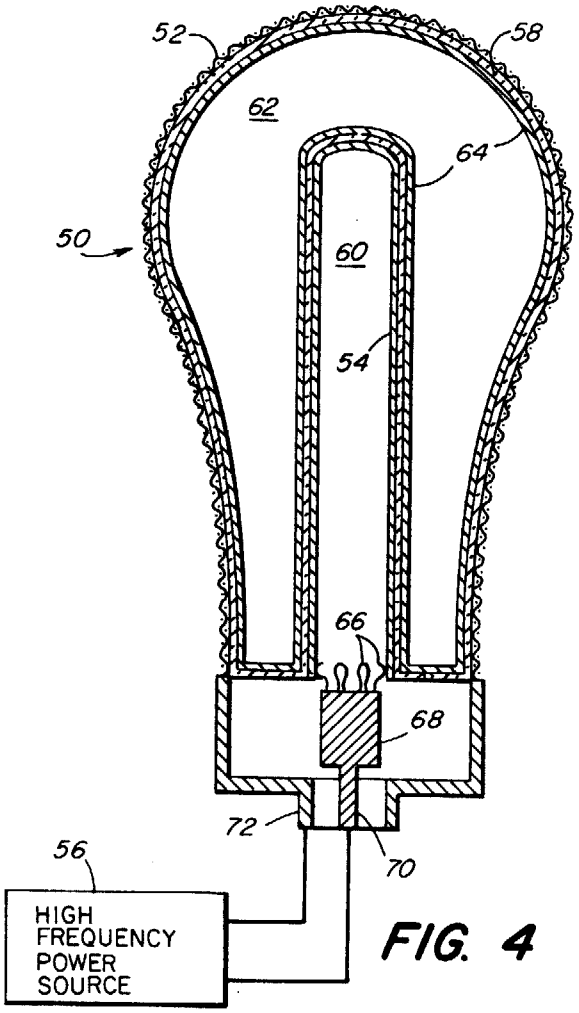

FIG. 4 illustrates a capacitively coupled compact fluorescent light source which is pear-shaped and has a metallized inner conductor.

Figure 5:
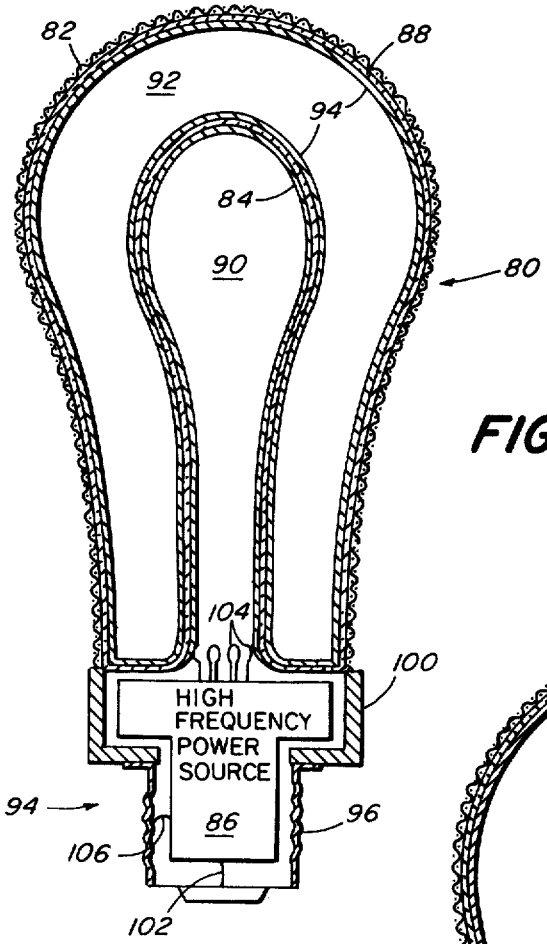

FIG. 5 illustrates a capacitively coupled compact fluorescent light source which has a pear-shaped, metallized inner conductor and includes a high frequency power source in the lamp base.

Figure 6:
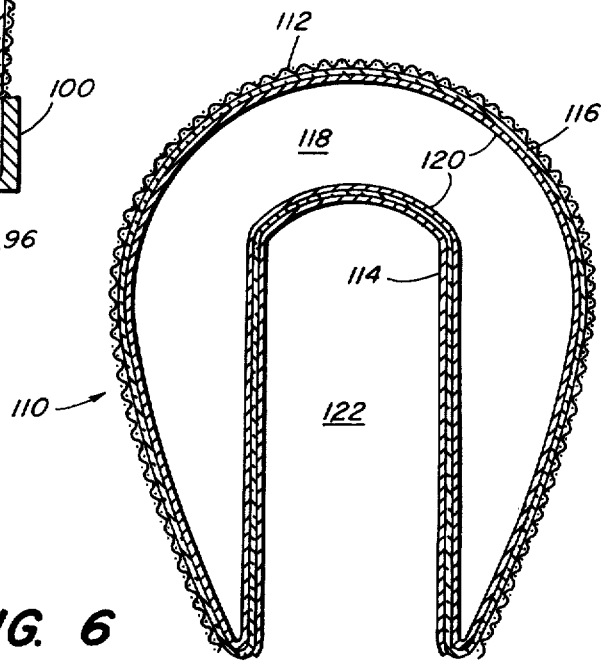

FIG. 6 illustrates a capacitively coupled compact fluorescent light source with increased surface area for lower frequency operation.

For a better understanding of the present invention, together with other and further objects, advantages and capabilities thereof, reference is made to the following disclosure and appended claims in connection with the above-described drawings.

DETAILED DESCRIPTION OF THE INVENTION

An electromagnetic discharge apparatus wherein high frequency power is capacitively coupled to the discharge is depicted in FIG. 1 as a planar fluorescent light source in order to aid in understanding the principles of capacitive coupling to a low pressure discharge. The light source includes a discharge lamp 10, first conductor 12, and second conductor 14 and can include high frequency power source 16. Discharge lamp 10 includes lamp envelope 18 made of a light transmitting substance such as glass which encloses in interior region 20 a fill material which forms during discharge a plasma which emits ultraviolet radiation. Lamp 10 has no metal electrodes internal to lamp envelope 18 and no conductors passing through lamp envelope 18. Lamp envelope 18, shown in FIG. 1, is generally planar in shape with two external surface regions which are parallel. The fill material typically includes at least one noble gas and mercury vapor in equilibrium with a small droplet of mercury within envelope 18. Alternatively, a mercury-containing amalgam can be used in place of the mercury droplet. A thin phosphor coating 22 is applied to the inner surface of lamp envelope 18. First conductor 12 and second conductor 14 are located in close proximity to the first and second external surface regions, respectively, of lamp envelope 18. At least one of the conductors is optically transparent to permit light to exit from the apparatus. For example, conductive wire mesh can be used as illustrated by first conductor 12 in FIG. 1. As used herein, the term "high frequency" refers to frequencies in the range from 10 MHz to 10 GHz. A preferred frequency range is the ISM band (industrial, scientific, and medical band) which ranges from 902 MHz to 928 MHz. One preferred frequency of operation is 915 MHz. Another preferred frequency is approximately 40 MHz.

When high frequency power source 16 is coupled to first conductor 12 and second conductor 14, an alternating electric field is induced in the region between conductors 12 and 14. The electric field lines 24 originate on one conductor and terminate on the other conductor. Since lamp envelope 18 is located between and substantially fills the region between first conductor 12 and second conductor 14, substantially all the electric field induced by conductors 12 and 14 is confined within discharge lamp 10. The confinement of the electric field within discharge lamp 10 results in relatively easy starting of the discharge since high field regions near conductors are located within discharge lamp 10. The electric field causes the fill material within region 20 to undergo electrical breakdown and subsequently a substantially steady plasma discharge forms throughout region 20. With the fill materials described above, the plasma discharge emits ultraviolet light, particularly at 254 nanometers wavelength. Phosphor coating 22 emits visible light upon absorption of ultraviolet light. When a source of ultraviolet light is desired, phosphor coating 22 is omitted and envelope 18 is fabricated from material such as fused silica which is transparent to ultraviolet light.

Optimizing the transfer of power from high frequency power source 16, having a characteristic output impedance $Z_O$, to the plasma discharge in region 20 is a matter of impedance matching. Referring now to FIG. 2a, discharge lamp 10 and conductors 12 and 14 can be represented as having an impedance $Z_L$ which is coupled to the output of high frequency power source 16. A simplified equivalent circuit of discharge lamp 10 and conductors 12 and 14 is shown in FIG. 2b wherein the series combination of $R_p$, $C_1$, and $C_2$ is coupled to the output of high frequency power source 16. Since the plasma discharge in region 20 is conductive, its effective electrical impedance is represented by resistor $R_p$. $C_1$ represents the capacitance between first conductor 12 and the plasma in region 20 which is viewed as an electrode of $C_1$. $C_2$ represents the capacitance between second conductor 14 and the plasma in region 20 which is viewed as an electrode of $C_2$. Lamp envelope 18 is the dielectric material between the electrodes of both $C_1$ and $C_2$.

It is to be understood that the representation herein of discharge lamps and associated conductors by an equivalent circuit including $C_1$, $C_2$, and $R_p$ is a simplified characterization of the actual apparatus. While the plasma is characterized as forming resistor $R_p$ and one electrode of each of capacitors $C_1$ and $C_2$, the plasma in fact is a gas which has a complex impedance and which is distributed throughout the lamp envelope. The plasma, therefore, is not to be misunderstood as being a lumped, highly conductive capacitor electrode in the conventional sense.

Referring to FIG. 2a, it is well known that the voltage reflection coefficient R for high frequency oscillations incident upon $Z_L$ from power source 16 having output impedance $Z_O$ is given by:

$$R = \frac{Z_L - Z_0}{Z_L + Z_0}$$

When $Z_L$ is described by the circuit of FIG. 2b, the reflection coefficient becomes:

$$R = \frac{1 + (2\pi fC)^2(R_p^2 - Z_0^2) - 4j\pi fCZ_0}{1 + (2\pi fC)^2(R_p + Z_0)^2}$$

where f = frequency of power source 16

$$C = \frac{C_1C_2}{C_1 + C_2}$$

if $2\pi fC$ becomes indefinitely large:

$$R = \frac{R_p - Z_0}{R_p + Z_0}$$

Thus, if $R_p$ is approximately equal to $Z_O$, the reflection coefficient approaches zero and power is optimally delivered to the plasma discharge. To obtain large values of $2\pi fC$, which result in low values of impedance of $C_1$ and $C_2$, high frequencies and large values of $C_1$ and $C_2$ are utilized. High values of $C_1$ and $C_2$ are obtained by using conductors 12 and 14 with large surface area. The value of $C_1$ and $C_2$ is also increased by decreasing the spacing between the electrodes of $C_1$ and $C_2$, that is, by decreasing the thickness of lamp envelope 18. To attain efficient transfer of power to the discharge, the impedances of $C_1$ and $C_2$ are, preferably, less than about 10% of the impedance of the plasma, $R_p$, at the operating frequency. When the capacitive impedances of $C_1$ and $C_2$ are greater than about 10% of the plasma impedance, $R_p$, it is necessary to utilize matching components as described hereinafter to optimize the transfer of power to the discharge. Since the capacitive impedances of $C_1$ and $C_2$ increase at lower frequencies of operation, any given light source configuration has an associated minimum frequency of operation below which power transfer becomes inefficient and matching components are necessary. This minimum frequency of operation varies with discharge lamp size and shape, conductor area, lamp envelope thickness, and lamp fill material. While the value of $R_p$ depends on the fill material used, it has been found that when lamp envelope 18 contains neon at a pressure of a few torr with mercury present, the value of $R_p$ is approximately 50 ohms. In addition, it has been found that, for configurations described hereinafter, the capacitive impedances of $C_1$ and $C_2$ are negligible at frequencies above about 500 MHz. Thus, a high frequency power source having a 50 ohm output impedance can efficiently deliver power to a plasma discharge without the use of additional matching elements when the operating frequency is above about 500 MHz. Virtually reflectionless discharges have been obtained at 915 MHz.

At lower frequencies of operation and when the values of $C_1$ and $C_2$ are relatively low, circuit elements such as $Z_1$ and $Z_2$ as shown in FIG. 2c can be used to accomplish matching between high frequency power source 16 having output impedance $Z_O$ and the discharge apparatus having impedance $Z_L$. Such techniques for matching are well known and described in P. M. Smith, *Electronic Applications of the Smith Chart*, pp. 115–128, McGraw-Hill, New York. $Z_2$ is coupled directly across the output of high frequency power source 16. $Z_1$ is connected in series with load impedance $Z_L$ and the series combination of $Z_L$ and $Z_1$ is coupled directly across the output of high frequency power source 16. $Z_1$ and $Z_2$ can be inductors or capacitors or combinations thereof with values depending on the frequency of operation and the values of impedances $Z_O$ and $Z_L$. Matching components are undesirable because of the increased cost and reduced reliability associated with their use.

Capacitive coupling of high frequency power to low pressure discharges in lamps of the type described above can therefore be accomplished by performing the following steps. A first conductor 12 is positioned in close proximity to a first external surface region of discharge lamp 10 such that first conductor 12 and the plasma in region 20 act as a first electrode pair, separated by lamp envelope 18, of a first capacitor $C_1$ which is configured to have an impedance, at said high frequency, which is much less than the impedance $R_p$ of the plasma. A second conductor 14 is positioned in close proximity to a second external surface region of discharge lamp 10 such that second conductor 14 and the plasma in region 20 act as a second electrode pair, separated by lamp envelope 18, of a second capacitor $C_2$ which is configured to have an impedance, at said high frequency, which is much less than the impedance $R_p$ of the plasma. The impedances of $C_1$ and $C_2$ at the frequency of operation are, preferably, less than about 10% of the plasma impedance $R_p$ to avoid the necessity for matching components as described hereinabove. First conductor 12 and second conductor 14 are positioned so that, when a high frequency voltage is applied between conductors 12 and 14, inducing an electric field 24 therebetween, substantially all of electric field 24 is confined within discharge lamp 10. High frequency power is applied to first conductor 12 and second conductor 14 for inducing electric fields 24 in envelope 18 and causing discharge in the plasma. It has been found that capacitively coupled discharges operated in accordance with the above method tend toward uniformly distributed plasma within lamp envelope 18 and are, therefore, those which are optimal with respect to light generation.

The requirements discussed hereinabove for optimum capacitive coupling of high frequency power are met in the preferred embodiments of the present invention shown in FIGS. 3–6. An electromagnetic discharge apparatus is illustrated in FIG. 3 as a compact fluorescent light source including discharge lamp 30, outer conductor 32, and inner conductor 34, and can include high frequency power source 35.

Discharge lamp 30 includes lamp envelope 36 which has an outer surface which is generally pear-shaped and is similar in size and shape to commonly used incandescent lamps which are generally pear-shaped. Lamp envelope 36 includes a re-entrant cavity 38 which is generally cylindrical in shape. A re-entrant cavity can be defined for the purposes of this disclosure as an open-ended cavity extending into a lamp envelope but not passing through the wall of the lamp. Thus, the re-entrant cavity is surrounded by the material of the lamp envelope except for the opening on the outer surface of the lamp envelope. Furthermore, the inner surface of the re-entrant cavity is external to the volume enclosed by the lamp envelope. While re-entrant cavity 38 is cylindrical in shape, re-entrant cavities, in general, can be of any shape. The fill material in interior region 40 forms during discharge a plasma which emits ultraviolet radiation. A small droplet of mercury with a noble gas (helium, neon, argon, krypton, xenon) or mixtures of noble gases are typically used. Mercury-containing amalgams can be used in place of mercury. One preferred fill material is neon at a pressure of a few torr and about 3 milligrams of mercury. Lamp envelope 36 has on its inner surface a phosphor coating 42 which emits visible light upon absorption of ultraviolet light. Phosphors commonly used in commercially available fluorescent lamps are suitable for use in the present invention. One suitable phosphor is calcium halophosphate. However, known rare earth phosphors and blends thereof are preferred because of their ability to withstand the relatively high wall loading characteristic of the light source according to the present invention. Wall loading is the lamp power dissipation per unit area of light emitting surface.

Inner conductor 34 can be solid or hollow and preferably fills re-entrant cavity 38. It has been found that the efficiency of the light source is increased if the surface of inner conductor 34 is polished to reflect light generated by discharge lamp 30 back into and through discharge lamp 30. Outer conductor 32, which is an optically transparent conductor such as metal mesh, substantially surrounds the outer surface of lamp envelope 36. In this discussion, the outer surface of lamp envelope 36. is defined as excluding the surface of re-entrant cavity 38. In the configuration of FIG. 3, the plasma discharge is confined in a generally annular region 40 bounded by a relatively large diameter inner conductor 34 and an optically transparent outer conductor 32 which is generally coaxial with inner conductor 34. Comparing the configuration of FIG. 3 with the parallel configuration of FIG. 1, the outer surface of envelope 36 corresponds to the first external surface region of envelope 18 and the surface of re-entrant cavity 38 corresponds to the second external surface region of envelope 18. Thus, the principles of capacitive coupling of high frequency power to the plasma discharge discussed hereinabove apply to the geometry of FIG. 3. Outer conductor 32 and inner conductor 34 are coupled to conductive members 44 and 46, respectively. High frequency power source 35 is coupled, typically by coaxial cable, to conductive members 44 and 46. Conductive members 44 and 46 are operative to support discharge lamp 30 and to electrically couple outer conductor 32 and inner conductor 34 to high frequency power source 35. While the configuration shown in FIG. 3 is satisfactory, numerous other coupling and lamp support arrangements can be used without departing from the scope of the present invention.

When high frequency power is applied to conductors 32 and 34, an electrical field running radially between outer conductor 32 and inner conductor 34 causes the gas in region 40 to undergo electrical breakdown and subsequently a substantially steady plasma discharge forms throughout region 40. When the fill materials described above are used, the discharge is a source of ultraviolet light, particularly at 254 nanometers. Phosphor coating 42 emits visible light upon absorption of ultraviolet light from the plasma discharge. When a source of ultraviolet light is desired, phosphor coating 42 is omitted and envelope 36 is fabricated from material such as fused silica which is transparent to ultraviolet light.

In establishment and maintenance of a substantially uniform discharge in the lamp shown in FIG. 3, high frequency power is capacitively coupled through the wall of lamp envelope 36 to region 40 and a plasma discharge having an effective electrical impedance results as described hereinabove. Outer conductor 32 is disposed around the outer surface of envelope 36 such that outer conductor 32 and the plasma in region 40 act as a first electrode pair, separated by lamp envelope 36, of a first capacitor which is configured to have an impedance at the frequency of operation which is much less than the impedance of the plasma. Inner conductor 34 is disposed in re-entrant cavity 38 such that inner conductor 34 and the plasma in region 40 act as a second electrode pair, separated by lamp envelope 36, of a second capacitor which is configured to have an impedance at the frequency of operation which is much less than the impedance of the plasma. The impedances of the first and second capacitors at the frequency of operation are preferably less than about 10% of the impedance of the plasma to avoid the necessity for matching components as described hereinabove. Conductors 32 and 34 are positioned so that when a high frequency voltage is applied between conductors 32 and 34, inducing an electric field therebetween, substantially all of the electric field is confined within discharge lamp 30. Experiments have shown that capacitive coupling is enhanced when inner conductor 34 substantially fills the available space in re-entrant cavity 38. For the configuration shown in FIG. 3, the impedance of the coupling capacitance above a frequency of approximately 500 MHz is much less than the impedance of the plasma discharge. Under these conditions, the load presented to high frequency power source 16 is dominantly resistive. Using the preferred fill material described above, the plasma resistance is approximately 50 ohms and efficient light generation is achieved. Under these conditions, no impedance matching or transformation is required when high frequency power source 35 is designed to operate into a 50 ohm resistive load. At frequencies below approximately 500 MHz, the impedance of the coupling capacitance becomes progressively more important with decreasing frequency. Under these circumstances, it is necessary to add a network, as shown in FIG. 2c and described hereinabove, to match the impedance of the discharge apparatus to the impedance of high frequency power source 35.

The outer shape of the lamp shown in FIG. 3 has numerous advantages in addition to any esthetic or psychological advantages achieved from its resemblance to typical incandescent lamp shapes. The shape figures prominently in the performance of the lamp relative to thermal uniformity, operating life, emitted light distribution, and starting. While the shape shown in FIG. 3 is the preferred shape, various other similar shapes are included within the scope of the present invention. In general, lamp envelopes of the present invention include a base region through which the re-entrant cavity passes and an enlarged region wherein the re-entrant cavity terminates and which has a larger cross-sectional area than the base region. These lamps envelopes are tapered inwardly from the enlarged region to the base region to form a continuous outer surface. Thus, in addition to the shape illustrated in FIG. 3, the lamp envelope, for example, can have an enlarged region which is generally spherical or can have an enlarged region which is generally cylindrical. Also, a lamp envelope having an overall cylindrical outer shape is satisfactory, although less desirable.

With respect to thermal uniformity, experiments have shown that the lamp envelope shape illustrated in FIG. 3 yields a surface temperature on outer portions of envelope 36 which varies only slightly from point to point. As a result, and in marked contrast to other envelope shapes which have been tested, the operating stability is substantially improved. Because of the absence of strong thermal gradients or hot and cold spots, the distribution of condensed mercury is relatively stable in its location as the lamp is warmed following ignition. This tends to promote conditions of stability in the plasma discharge distribution, in the light intensity, and in the electrically impedance presented to the high frequency power source.

With respect to operating life, it is known that the useful light emitting life of a phosphor coating material is determined, in part, by wall loading. Wall loading is reduced by increasing the surface area of the lamp, such reduction leading to extended operating life of the lamp. The shape illustrated in FIG. 3 provides a relatively large surface area while avoiding the elongated tube which is characteristic of conventional fluorescent lamps.

With respect to emitted light distribution, the crudely spherical shape of this lamp has an approximately isotropic radiation pattern similar to that of a frosted incandescent lamp. As a result, the replacement of an incandescent lamp by the apparatus of FIG. 3 does not cause noticeable changes in illumination pattern.

With respect to the starting of discharges in lamps of the type depicted in FIG. 3, experiments have shown that the existence of an enlarged, substantially globular region of lamp envelope 36, together with the proximity of conductors 32 and 34 to envelope 36, results in a condition favoring relatively easy breakdown and ionization of the low pressure gas contained in region 40. It is well known to those skilled in the art that the high frequency breakdown of a particular gas is determined by the applied electric field, its frequency of oscillation, the pressure of the gas, its chemical composition, and, importantly, the dimensions of the field-containing vessel. It is also known that a minimum value of the applied field required for breakdown occurs at a particular gas pressure. Somewhat lower pressures and, accordingly, lower field strengths are required as the containing vessel is made larger. Further details concerning the parameters of breakdown of this type are delineated in standard references such as S. C. Brown, Basic Data of Plasma Physics MIT/Wiley, New York (1959) p. 145. Experiments have shown that minimum field conditions for breakdown or starting of the discharge in region 40 occur with a pressure in neon of about 6 torr. At this pressure, the lamp shown in FIG. 3 starts with an incident high frequency power of 4 to 10 watts at 915 MHz. It has also been observed that fill pressures in this range are conducive to efficient operation of the lamp. The light source disclosed herein has an efficacy in the range of 100 lumens per watt of high frequency power. Therefore, the equivalent light production of a standard 100 watt incandescent lamp is provided by the light source shown in FIG. 3 with only 15 to 20 watts of high frequency power. The relatively easy starting conditions of the present lamp permit starting of the light source by the application of normal running power. Thus, an important feature of the present light source is that no starting circuits or other starting aids are required to initiate discharge.

While the compact fluorescent light sources depicted in FIGS. 4–6 differ in certain respects from each other and from the light sources shown in FIGS. 1 and 3, the discussion hereinabove of lamp shapes, fill materials, phosphor coatings, frequencies of operation, and capacitive coupling techniques applies fully to the light sources of FIG. 4–6 and is hereby incorporated into their description which follows.

A compact fluorescent light source utilizing metallized electrodes is shown in FIG. 4 and includes discharge lamp 50, outer conductor 52, and inner conductor 54 and can include high frequency power source 56.

Discharge lamp 50 includes lamp envelope 58, which has an outer surface which is generally pear-shaped, and re-entrant cavity 60 which is generally cylindrical in shape. Lamp 50 also includes in interior region 62 a fill material which forms during discharge a plasma which emits ultraviolet radiation and has on its inner surface a phosphor coating 64 which emits visible light upon absorption of ultraviolet light. The discussion hereinabove of discharge lamp 30 with respect to variations of lamp shapes, advantages of the disclosed lamp shapes, and suitable fill materials and phosphor coatings is applicable to discharge lamp 50. Outer conductor 52, which is an optically transparent conductor such as metal mesh, substantially surrounds the outer surface of lamp envelope 36 except for the surface of re-entrant cavity 60. Inner conductor 54 is a conductive coating disposed on the inner surface of re-entrant cavity 60 to form a metallized electrode. Electrical contact to inner conductor 54 is made by conductive resilient fingers 66 which are coupled to conductive member 68 which in turn is coupled to conductive member 70. Conductive member 72 is coupled to outer conductor 52. Conductive members 70 and 72 are also coupled to high frequency power source 56. Conductive members 68, 70, and 72 and resilient fingers 66 are operative to support discharge lamp 50 and to electrically couple outer conductor 52 and inner conductor 54 to high frequency power source 56. While the configuration shown in FIG. 4 is satisfactory, numerous other coupling and lamp support arrangements can be used without departing from the scope of the present invention.

Inner conductor 54 can be fabricated by any convenient metallization technique. Well known vacuum deposition techniques can be used. A layer of chrome is first applied to the inner surface of re-entrant cavity 60. Then a layer of conductive metal such as aluminum is applied over the chrome layer. Inner conductor 54 can also be formed by painting the inner surface of re-entrant cavity 60 with a conductive epoxy. It is preferred that inner conductive 54 have a light reflecting surface which is operative to reflect light emitted from discharge lamp 50 back to and through discharge lamp 50. Outer conductor 52, which is typically a conductive mesh, can alternatively be a conductive coating disposed on the outer surface of lamp envelope 58. The conductive coating is typically in a pattern which permits light to escape from the apparatus. One example is a grid pattern.

When the conductive coating which forms inner conductor 54 is substantially more than one skin depth in thickness, then re-entrant cavity 60 is substantially field-free. Skin depth is a well known quantity which is related to the fact that high frequency power travels near the surface of a conductor rather than being uniformly distributed in the conductor. Skin depth is a measure of the depth to which high frequency power penetrates the conductor and decreases as the frequency of operation of the light source increase. Furthermore, when outer conductor 52 is substantially more than one skin depth in thickness, the light source is prevented from radiating power at high frequency. As an example, aluminum has a skin depth of about 3 microns for an operating frequency of 915 MHz. Therefore, an inner conductor 54 of at least 10 microns thickness results in a substantially field-free re-entrant cavity 60 at 915 MHz and an outer conductor 52 of at least 10 microns thickness prevents radiation of 915 MHz power. At lower frequencies of operation, thicker conductors are required to achieve effective shielding.

A preferred embodiment of a compact fluorescent light source wherein the inner conductor is a conductive coating disposed on the lamp envelope is depicted in FIG. 5. The light source includes discharge lamp 80, outer conductor 82, and inner conductor 84 and can include high frequency power source 86. Discharge lamp 80 includes lamp envelope 88, which has an outer surface which is generally pear-shaped, and re-entrant cavity 90 which has substantially the same shape as the outer surface of envelope 88. Lamp 80 also includes in interior region 92 a fill material which forms during discharge a plasma which emits ultraviolet radiation and has on its inner surface a phosphor coating 94 which emits visible light upon absorption of ultraviolet light. The discussion hereinabove of discharge lamp 30 with respect to variations of lamp shapes, advantages of the disclosed lamp shapes, capacitive coupling techniques, and suitable fill materials and phosphor coatings is applicable to discharge lamp 80.

Outer conductor 82, which is an optically transparent conductor such as metal mesh, substantially surrounds the outer surface of lamp envelope 88 except for the surface of re-entrant cavity 90. Inner conductor 84 is a conductive coating disposed on the inner surface of re-entrant cavity 90 to form a metallized electrode. The discussion hereinabove of application techniques and thickness of conductor 54 in FIG. 4 is applicable to inner conductor 84. The use of a metallized electrode permits inner conductor 82 to follow the contours of re-entrant cavity 90. Since re-entrant cavity 90 has the same general shape as the outer surface of lamp envelope 88, the spacing between outer conductor 82 and inner conductor 84 is generally uniform and a more uniform light output results for reasons stated hereinafter. The use in re-entrant cavity 90 of solid or hollow electrodes which have the shape of re-entrant cavity 90 is impractical because of the problem of positioning such an electrode in cavity 90. When discharge lamps having other outer shapes are used, the shape of the re-entrant cavity can be made to correspond with the outer shape of the lamp envelope thus insuring a more or less uniform spacing between inner and outer conductors. Outer conductor 82 alternatively can be a conductive coating disposed on the outer surface of envelope 88 in a pattern, as described hereinabove.

In contrast to separate solid or hollow conductors, electrode formed as metallic coatings on the surface of lamp envelope 88 have the following advantages: (1) The use of a substantially pear-shaped electrode, made possible by metallization, results in uniform selftrapping of 254 nm radiation in the mercury vapor and reduced self-trapping or imprisonment of this radiation in the largest diameter, globular portion of the lamp. The result is increased light output and a more uniformly activated phosphor surface. (2) The increased surface area and inherently close proximity of the metallized surface to the envelope material, ensures increased and maximized capacitance between the metallization and the plasma. This results in improved coupling at all frequencies and a lowering of the minimum frequency which may be used effectively. (3) The metallized surface facing the plasma discharge will typically present a highly reflecting, nearly mirror quality, surface to visible light propagating inward toward the re-entrant cavity. This results in improved light output, contributing to the isotropic visible radiation from the lamp. More-over, the metallized surface facing the discharge is permanently protected from oxidation or other chemical attack and so retains its mirror quality. (4) The metallized electrode has extremely small mass, a factor which contributes to the ruggedness of this lamp over filamented lamps or lamps in the prior art which contain massive coils or magnetic material. (5) The metallized electrode leaves a field-free cavity 90 within the lamp which can, where needed, contain circuit components or other articles necessary to the lamp's operation. (6) The metallized electrode is permanently bonded to the glass or other envelope material thereby providing automatic disconnection of the high frequency source when envelope 88 is removed or broken.

In the preferred embodiment of FIG. 5, high frequency power source 86 is located in lamp base 94 which includes screw-in base 96 and conductive member 100. Base 96 can be the type commonly used on incandescent lamps for connection to 115 volts ac 60 Hz household power and commonly known as an Edison screw base. High frequency power source 86, which is coupled to the conductors of base 96 by conductors 102 and 106, receives 110 volts ac 60 Hz power through base 96 and generates high frequency output power which is coupled to inner conductor 84 through resilient conductive fingers 104. Outer conductor 82 is coupled to ground through conductive member 100 and base 96. Since discharge lamp 80 has a resistive impedance of approximately 50 ohms as discussed hereinabove, various well known high frequency, solid state power sources can be used to power the light source. Since high frequency power source 86 is incorporated into lamp base 94, the light source can be used as a screw-in replacement for an incandescent lamp.

It will be obvious to those skilled in the art that various other lamp base configurations can be utilized without departing from the scope of the present invention. Also, discharge lamp 80, outer conductor 82 and inner conductor 84 can be utilized in conjunction with a remote high frequency power supply as illustrated in FIG. 4. Furthermore, the configuration of power source and lamp base shown in FIG. 5 can be utilized in the light sources shown in FIGS. 3 and 4.

A preferred embodiment of a compact fluorescent light source which can be operated at lower frequencies is illustrated in FIG. 6. The light source includes discharge lamp 110, outer conductor 112, and inner conductor 114. Discharge lamp 110 can be supported and electrically coupled to a high frequency power source as shown in FIG. 4 or as shown in FIG. 5 or by other configurations which will be obvious to those skilled in the art. Lamp 110 includes lamp envelope 116 which has in interior region 118 a fill material which forms during discharge a plasma which emits ultraviolet radiation and has on its inner surface a phosphor coating 120 which emits visible light upon absorption of ultraviolet light. The discussion hereinabove of discharge lamp 30 with respect to variations of lamp shapes, advantages of the disclosed lamp shapes, capacitive coupling techniques, and suitable fill materials and phosphor coatings is applicable to discharge lamp 110. Lamp envelope 116 has a larger diameter and therefore a larger outer surface area than envelope 36 in FIG. 3. Thus, outer conductor 112, which surrounds the outer surface of discharge lamp 110, also has a greater surface area than outer conductor 32 in FIG. 3. Also, lamp envelope 116 has a re-entrant cavity 122 of substantially larger diameter and therefore larger surface area than re-entrant cavity 38 in FIG. 3. Thus, inner conductor 114, which is a conductive coating disposed on the inner surface of re-entrant cavity 122, has a larger surface area than inner conductor 34 in FIG. 3. Outer conductor 112 is optically transparent, for example a metal mesh, while inner conductor 114 can be formed according to the techniques discussed hereinabove in connection with conductor 54 in FIG. 4. Outer conductor 112 alternatively can be a conductive coating disposed on the outer surface of envelope 116 in a pattern, as described hereinabove. The large surface areas of inner conductor 114 and outer conductor 112 provide a substantial increase in coupling capacitance which is desirable at the lower end of the usable frequency range as discussed hereinabove. Discharge lamp 110 having increased coupling capacitance, can also be utilized in a light source wherein the inner conductor is a solid or hollow conductor rather than a conductive coating.

Thus, the light sources shown in FIGS. 4–6 include a discharge lamp as above described, an inner conductor and an outer conductor. The outer conductor is disposed around the outer surface of the lamp envelope such that the outer conductor and the plasma act as a first electrode pair, separated by the lamp envelope, of a first capacitor which is configured to have an impedance at the frequency of operation which is much less than the impedance of the plasma. The inner conductor is a conductive coating disposed on the inner surface of the re-entrant cavity such that the inner conductor and the plasma act as a second electrode pair, separated by the lamp envelope, of a second capacitor which is configured to have an impedance at the frequency of operation which is much less than the impedance of the plasma. The impedance of the first and second capacitors at the frequency of operation are preferably less than 10% of the plasma impedance to avoid the necessity for matching components as described hereinabove. The inner and outer conductors are adapted for receiving high frequency power and are positioned so that when a high frequency voltage is applied between the inner and outer conductors, inducing an electric field therebetween, substantially all of the electric field is confined within the discharge lamp.

Figure 2:
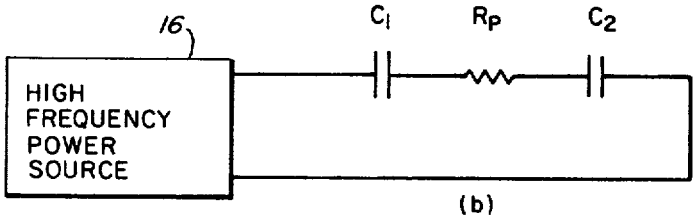
Figure 2:
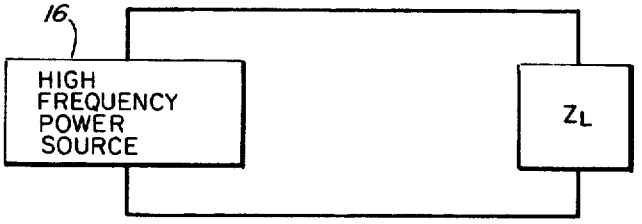
Figure 2:
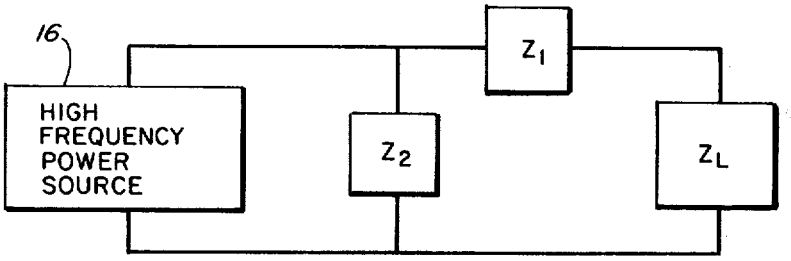

High frequency power source 16 in FIGS. 1 and 2, power source 35 in FIG. 3, power source 56 in FIG. 4, and power source 86 in FIG. 5 can be any suitable high frequency power source capable of supplying the required power level at the operating frequency of the light source. In general, the high frequency power sources used herein convert dc or low frequency ac power to high frequency power in the 10 MHz to 10 GHz range. For example, the light source disclosed herein which has a light output equivalent to a 100 watt incandescent lamp requires 20 watts at 915 MHz with a 50 ohm source impedance. The most common input power is 60 Hz, 115 volt ac household power. With suitable design changes well known to those skilled in the art, the high frequency power sources used herein can be made to operate from 50 Hz, 400 Hz, or three-phase inputs. Also, the input voltage level is a matter of design choice. One suitable power source is shown in U.S. Pat. No. 4,070,603 issued Jan. 24, 1978 to Regan et al. When this power source is used in the incandescent replacement light source shown in FIG. 5, a dc power source is added to convert the 60 Hz input to dc.

Tubulations, used for introduction of phosphor coating materials and lamp fill materials into the discharge lamp, are not shown in FIGS. 1 and 3–6. However, these may be located at various points on the lamp envelope depending on preferred manufacturing technique.

Light sources constructed as herein disclosed provide, with an input high frequency power of only 15 to 20 watts, light output equal to or greater than that produced by a 100 watt incandescent lamp. Whereas inductively coupled electrodeless fluorescent light sources have claimed outputs of 80 lumens per watt of high frequency input power, the light sources herein disclosed have outputs in the range of 100 lumens per watt of high frequency input power. Further testing reveals that this light source operates with a useful life of at least 5000 hours. Other tests have shown that the light source disclosed herein starts and hot starts reliably, that it is unaffected by orientation, and that its low surface temperature is within a safe range in the event of personal contact. Furthermore, the light output can be dimmed over a wide range by varying the input high frequency power level. Thus, it is seen that the light source disclosed herein provides energy efficiency, elimination of massive coils and magnetic material, a uniform light otput, long operating life, and ruggedness.

While there has been shown and described what is at present considered the preferred embodiments of the invention, it will be obvious to those skilled in the art that various changes and modifications may be made therein without departing from the scope of the invention as defined by the appended claims.

What is claimed is:

1. A method for capacitive excitation, by high frequency power, of a low pressure discharge in a discharge lamp having a lamp envelope made of a light transmitting substance, said envelope enclosing a fill material which forms during discharge a plasma which emits ultraviolet radiation and has an effective electrical impedance, said method comprising the steps of:

positioning a first conductor in close proximity to a first external surface region of said discharge lamp such that said first conductor and said plasma act as a first electrode pair, separated by said lamp envelope, of a first capacitor which is configured to have an impedance, at said high frequency, which is much less than the impedance of said plasma;

positioning a second conductor in close proximity to a second external surface region of said discharge lamp such that said second conductor and said plasma act as a second electrode pair, separated by said lamp envelope, of a second capacitor which is configured to have an impedance, at said high frequency, which is much less than the impedance of said plasma;

positioning said first and second conductors relative to each other so that, when a high frequency voltage is applied between said first and second conductors, inducing an electric field therebetween, substantially all of said electric field is confined within said discharge lamp; and applying high frequency power to said first and second conductors for inducing an electric field in said lamp and causing discharge therein.

2. The method as defined in claim 1 wherein said lamp envelope has an inner surface with a phosphor coating thereon which emits visible light upon absorption of ultraviolet radiation.

3. The method as defined in claim 2 wherein said lamp envelope includes at least one re-entrant cavity having an inner surface and wherein said second external surface region is the inner surface of said re-entrant cavity.

4. The method as defined in claim 3 wherein the step of applying high frequency power to said conductors includes the step of coupling said first and second conductors to a high frequency power source.

5. The method as defined in claim 4 wherein said high frequency power source has an output impedance and wherein said method further includes the step of matching said output impedance to the impedance of said plasma.

6. An electromagnetic discharge apparatus for capacitive excitation of a low pressure discharge by high frequency power, said apparatus comprising:

a discharge lamp having a lamp envelope made of a light transmitting substance, said envelope including an outer surface and at least one re-entrant cavity and enclosing a fill material which forms during discharge a plasma which emits ultraviolet radiation and has an effective electrical impedance;

an outer conductor disposed around the outer surface of said envelope such that said outer conductor and said plasma act as a first electrode pair, separated by said lamp envelope, of a first capacitor which is configured to have an impedance at said high frequency which is much less than the impedance of said plasma;

an inner conductor disposed in said re-entrant cavity such that said inner conductor and said plasma act as a second electrode pair, separated by said lamp envelope, of a second capacitor which is configured to have an impedance at said high frequency which is much less than the impedance of said plasma; and means for coupling said apparatus to a source of high frequency power, said inner and outer conductors being positioned so that when a high frequency voltage is applied between said inner and outer conductors, inducing an electric field therebetween, substantially all of said electric field is confined within said discharge lamp, whereby high frequency power applied to said inner and outer conductors induces an electric field in said lamp and causes discharge therein.

7. The electromagnetic discharge apparatus as defined in claim 6 wherein said lamp envelope has an inner surface with a phosphor coating thereon which emits visible light upon absorption of ultraviolet radiation.

8. The electromagnetic discharge apparatus as defined in claim 7 wherein said fill material in said discharge lamp includes mercury and at least one noble gas.

9. The electromagnetic discharge apparatus as defined in claim 7 wherein said fill material in said discharge lamp includes an amalgam and at least one noble gas.

10. The electromagnetic discharge apparatus as defined in claim 8 wherein the outer surface of said discharge lamp is cylindrical in shape.

11. The electromagnetic discharge apparatus as defined in claim 8 wherein said lamp envelope includes a base region through which said re-entrant cavity passes and an enlarged region wherein said re-entrant cavity terminates and which has a larger cross-sectional area than said base region, said lamp envelope being tapered inwardly from said enlarged region to said base region to form a continuous outer surface.

12. The electromagnetic discharge apparatus as defined in claim 11 wherein said enlarged region is generally spherical.

13. The electromagnetic discharge apparatus as defined in claim 11 wherein the outer surface of said discharge lamp is generally pear-shaped.

14. The electromagnetic discharge apparatus as defined in claim 11 wherein said enlarged region is generally cylindrical.

15. The electromagnetic discharge apparatus as defined in claim 11 wherein said re-entrant cavity and said inner conductor are generally cylindrical in shape.

16. The electromagnetic discharge apparatus as defined in claim 11 wherein said re-entrant cavity and said inner conductor have substantially the same shape as said outer surface.

17. The electromagnetic discharge apparatus as defined in claim 16 wherein said inner conductor includes a light reflecting surface which is operative to reflect light emitted from said lamp envelope back into said lamp envelope.

18. The electromagnetic discharge apparatus as defined in claim 17 wherein said re-entrant cavity includes an inner surface and said inner conductor includes an outer surface which substantially coincides with the inner surface of said re-entrant cavity.

19. An electromagnetic discharge apparatus for capacitive excitation of a low pressure discharge by high frequency power, said apparatus comprising:

a discharge lamp having a lamp envelope made of a light transmitting substance, said envelope including an outer surface, an inner surface with a phosphor coating thereon which emits visible light upon absorption of ultraviolet radiation, and at least one re-entrant cavity and enclosing a fill material which forms during discharge a plasma which emits ultraviolet radiation and has an effective electrical impedance;

an outer conductor disposed around the outer surface of said envelope such that said outer conductor and said plasma act as a first electrode pair, separated by said lamp envelope, of a first capacitor which is configured to have an impedance at said high frequency which is much less than the impedance of said plasma;

an inner conductor disposed in said re-entrant cavity such that said inner conductor and said plasma act as a second electrode pair, separated by said lamp envelope, of a second capacitor which is configured to have an impedance at said high frequency which is much less than the impedance of said plasma, said inner and outer conductors being positioned so that when high frequency power is applied to said inner and outer conductors, inducing an electric field therebetween, substantially all of said electric field is confined within said discharge lamp; and a high frequency power source coupled to said inner and outer conductors for inducing an electric field in said lamp and causing discharge therein.

20. The electromagnetic discharge apparatus as defined in claim 19 wherein said fill material in said discharge lamp includes mercury and at last one noble gas.

21. The electromagnetic discharge apparatus as defined in claim 20 wherein the high frequency power source has an output frequency in the range from 10 MHz to 10 GHz.

22. The elctromagnetic discharge apparatus as defined in claim 21 wherein the high frequency power source has an output frequency in the range from 902 MHz to 928 MHz.

23. The electromagnetic discharge apparatus as defined in claim 21 further including a lamp base which is operative to mount said discharge lamp and to contain therein said high frequency power source.

24. The electromagnetic discharge apparatus as defined in claim 21 further including means coupled between said inner and outer conductors and said high frequency power source for matching said power source to said inner and outer conductors and said discharge lamp during discharge.

25. The electromagnetic discharge apparatus as defined in claim 20 wherein said lamp envelope includes a base region through which said re-entrant cavity passes and an enlarged region wherein said re-entrant cavity terminates and which has a larger cross-sectional area than said base region, said lamp envelope being tapered inwardly from said enlarged region to said base region to form a continuous outer surface.

26. The electromagnetic discharge apparatus as defined in claim 25 wherein said enlarged region is generally spherical.

27. The electromagnetic discharge apparatus as defined in claim 25 wherein the outer surface of said discharge lamp is generally pear-shaped.

28. The electromagnetic discharge apparatus as defined in claim 25 wherein said re-entrant cavity and said inner conductor are generally cylindrical in shape.

29. The electromagnetic discharge apparatus as defined in claim 25 wherein said re-entrant cavity and said inner conductor have substantially the same shape as said outer surface.

30. The electromagnetic discharge apparatus as defined in claim 29 wherein said inner conductor includes a light reflecting surface which is operative to reflect light emitted from said lamp envelope back into said lamp envelope.

31. The electromagnetic dischage apparatus as defined in claim 30 wherein said re-entrant cavity includes an inner surface and said inner conductor includes an outer surface which substantially coincides with the inner surface of said re-entrant cavity.

32. The electromagnetic discharge apparatus as defined in claim 31 wherein said high frequency power source has an output impedance which is substantially equal to the impedance of said fill material during discharge.

33. An electromagnetic discharge apparatus for capacitive excitation of a low pressure discharge by high frequency power, said apparatus comprising:

a discharge lamp having a lamp envelope made of a light transmitting substance, said envelope including an outer surface, an inner surface with a phosphor coating thereon which emits visible light upon absorption of ultraviolet radiation, and at least one re-entrant cavity and enclosing a fill material which forms during discharge a plasma which emits ultraviolet radiation and has an effective electrical impedance;

an outer conductor disposed around the outer surface of said lamp envelope;

an inner conductor disposed in said re-entrant cavity; and a high frequency power source coupled to said inner and outer conductors for inducing an electric field in said lamp and causing discharge therein, said apparatus having a first capacitive impedance associated with coupling of high frequency power from said inner conductor to said plasma and having a second capacitive impedance associated with coupling of high frequency power from said outer conductor to said plasma, said inner and outer conductors having sufficient surface areas to produce first and second capacitive impedances, respectively, which are much less than the impedance of said plasma.

34. The electromagnetic discharge apparatus as defined in claim 33 wherein said lamp envelope includes a base region through which said re-entrant cavity passes and an enlarged region wherein said re-entrant cavity terminates and which has a larger cross-sectional area than said base region, said lamp envelope being tapered inwardly from said enlarged region to said base region to form a continuous outer surface.

35. An electromagnetic discharge apparatus for capacitive excitation of a low pressure discharge by high frequency power, said apparatus comprising:

a discharge lamp having a lamp envelope made of a light transmitting substance, said envelope including a re-entrant cavity with an external surface and enclosing a fill material which forms during discharge a plasma which emits ultraviolet radiation and has an effective electrical impedance, said envelope further including a base region through which said re-entrant cavity passes and an enlarged region wherein said re-entrant cavity terminates and which has a larger cross sectional area than said base region, said envelope being tapered inwardly from said enlarged region to said base region to form a continuous outer surface;

an outer conductor contiguous at least a portion of said outer surface of said envelope, exclusive of said external surface of said re-entrant cavity, said outer conductor having sufficient area to provide capacitive coupling of high frequency power at an impedance which is much less than the impedance of said plasma;

an inner conductor contiguous at least a portion of said external surface of said re-entrant cavity, said inner conductor having sufficient area to provide capacitive coupling of high frequency power at an impedance which is much less than the impedance of said plasma, said inner and outer conductors being configured so that when high frequency power is applied to said inner and outer conductors, inducing an electric field therebetween, substantially all of said electric field is confined within said discharge lamp; and a high frequency power source coupled to said inner and outer conductors for inducing an electric field in said lamp and causing discharge therein.

36. The electromagnetic discharge apparatus as defined in claim 35 wherein said re-entrant cavity has substantially the same shape as said outer surface of said lamp envelope.

37. The electromagnetic discharge apparatus as defined in claim 36 further including a lamp base which is operative to mount said discharge lamp and to contain therein said high frequency power source.

38. The electromagnetic discharge apparatus as defined in claim 37 wherein said high frequency power source has an output impedance which is substantially equal to the impedance of said fill material during discharge.

39. The electromagnetic discharge apparatus as defined in claim 38 wherein said lamp envelope has an inner surface with a phosphor coating thereon which emits visible light upon absorption of ultraviolet radiation and said fill material in said discharge lamp includes mercury and at least one noble gas.

40. The electromagnetic discharge apparatus as defined in claim 39 wherein said enlarged region is generally spherical.

* * * * *